US009904310B2

(12) United States Patent
Ihm et al.

(10) Patent No.: US 9,904,310 B2
(45) Date of Patent: Feb. 27, 2018

(54) REGULATOR CIRCUIT AND POWER SYSTEM INCLUDING THE SAME

(71) Applicant: Samsung Electronics Co., Ltd., Suwon-si, Gyeonggi-do (KR)

(72) Inventors: Jeong-Don Ihm, Seongnam-si (KR); Siddharth Katare, Hwaseong-si (KR)

(73) Assignee: SAMSUNG ELECRONICS CO., LTD., Gyeonggi-do (KR)

( * ) Notice: Subject to any disclaimer, the term of this patent is extended or adjusted under 35 U.S.C. 154(b) by 0 days.

(21) Appl. No.: 15/224,927

(22) Filed: Aug. 1, 2016

(65) Prior Publication Data

US 2017/0060164 A1 Mar. 2, 2017

(30) Foreign Application Priority Data

Sep. 2, 2015 (KR) ..... 10-2015-0123973

(51) Int. Cl.
*G05F 1/44* (2006.01)
*G05F 3/26* (2006.01)

(52) U.S. Cl.
CPC ..... *G05F 3/262* (2013.01)

(58) Field of Classification Search
CPC ..... F05F 1/565; G05F 1/575; G05F 3/262
USPC ..... 323/271–280, 311–316
See application file for complete search history.

(56) References Cited

U.S. PATENT DOCUMENTS 6,522,111 B2 2/2003 Zadeh et al.
6,933,772 B1 * 8/2005 Banerjee ..... G05F 1/565 323/277
7,166,991 B2 1/2007 Eberlein
7,982,448 B1 7/2011 Prasad et al.
7,986,499 B2 * 7/2011 Wang ..... G05F 3/262 361/18
8,344,713 B2 * 1/2013 Shrivas ..... G05F 1/575 323/273
8,471,539 B2 * 6/2013 Wu ..... G05F 1/575 323/275
9,235,225 B2 * 1/2016 Price ..... G05F 1/468
2005/0168272 A1 8/2005 Banerjee et al.
2009/0315526 A1 12/2009 Do Couto et al.
(Continued)

FOREIGN PATENT DOCUMENTS

CN 104407662 A 3/2015
KR 2002-0069181 A 8/2002
(Continued)

*Primary Examiner* — Rajnikant Patel

(74) *Attorney, Agent, or Firm* — Harness, Dickey & Pierce, P.L.C.

(57) ABSTRACT

A regulator circuit includes a power transistor, a current mirror, a first NMOS transistor, a second NMOS transistor and a current source. The power transistor has a source connected to an external power supply voltage supply, a gate connected to a first node having a first voltage and a drain connected to a second node outputting an internal power supply voltage. A current mirror provides a first current to a third node having a second voltage and provides a first node with a second current. A first NMOS transistor has a drain connected to a first node, a gate receiving a first reference voltage and a source connected to a fourth node. A second NMOS transistor has a drain connected to a third node, a gate connected to a second node and a source connected to the fourth node.

20 Claims, 10 Drawing Sheets

(56) References Cited

U.S. PATENT DOCUMENTS

| | | | | |
|---|---|---|---|---|
| 2010/0013449 | A1* | 1/2010 | Miki | G05F 1/56 323/282 |
| 2011/0001458 | A1 | 1/2011 | Bansal et al. | |
| 2011/0267017 | A1 | 11/2011 | Zhang et al. | |
| 2013/0113447 | A1 | 5/2013 | Kadanka | |
| 2013/0194039 | A1 | 8/2013 | Hirose et al. | |
| 2014/0125300 | A1 | 5/2014 | Price et al. | |

FOREIGN PATENT DOCUMENTS

| | | | |
|---|---|---|---|
| KR | 2012-007383 | A | 7/2012 |
| KR | 2013-0002358 | A | 1/2013 |

* cited by examiner

REGULATOR CIRCUIT AND POWER SYSTEM INCLUDING THE SAME

CROSS-REFERENCE TO RELATED APPLICATION

This U.S. non-provisional application claims priority under 35 USC § 119 to Korean Patent Application No. 10-2015-0123973, filed on Sep. 2, 2015, in the Korean Intellectual Property Office (KIPO), the disclosure of which is incorporated herein by reference in its entirety.

BACKGROUND

1. Field

Example embodiments relate generally to power devices, and more particularly to regulator circuits and power systems including regulator circuits.

2. Description of the Related Art

Recently, semiconductor memory devices have adopted a regulator circuit that converts a high external power supply voltage to a low internal power supply voltage because a level of an internal operating voltage is lowered. The operation of the semiconductor memory devices may be credible after a desired (or, alternatively, a predetermined) interval elapses from a time when the external power supply voltage is applied because the internal power supply voltage is stabilized during the desired (or, alternatively, a predetermined) interval.

The regulator circuits have a large-sized power transistor for supplying power to the semiconductor memory devices and the large-sized power transistor has a large capacitance.

SUMMARY

At least some example embodiments are directed to provide a regulator circuit capable of rapidly compensating for a change of an internal power supply voltage.

At least some example embodiments are directed to a power system including a regulator circuit capable of rapidly compensating for a change of an internal power supply voltage.

According to at least some example embodiments, a regulator circuit includes a power transistor, a source of the power transistor configured to receive an external power supply voltage, a gate of the power transistor connected to a first node and a drain of the power transistor connected to a second node, the power supply voltage configured to generate an internal power supply voltage, a current mirror configured to provide a first current to a third node, and the current mirror further configured to provide the first node with a second current, the second current having a same magnitude as the first current, a first n-channel metal-oxide semiconductor (NMOS) transistor, a drain of the first NMOS transistor connected to the first node and a source of the first NMOS transistor connected to a fourth node, a second NMOS transistor, a drain of the second NMOS transistor connected to the third node, a gate of the second NMOS transistor connected to the second node and a source of the second NMOS transistor connected to the fourth node, and a current source configured to draw a third current from the fourth node, the current source configured to generate a mirrored current having a same magnitude as the first current based on a voltage of the third node and configured to change a magnitude of the third current based on a difference between the mirrored current and a reference current.

According to at least some example embodiments, the current source is configured to increase a voltage adjustment time of the gate of the power transistor to reduce a returning time of a level of the internal power supply voltage to a first level, when i) the power transistor changes the level of the internal power supply voltage from the first level to a second level and ii) the regulator circuit changes a magnitude of a load current flowing through the power transistor.

According to at least some example embodiments, the current source is further configured to decrease the magnitude of the third current until the magnitude of the mirrored current reaches a magnitude of the reference current when the magnitude of the mirrored current is greater than the magnitude of the reference current.

According to at least some example embodiments, the current source is configured to increase the magnitude of the third current until the magnitude of the mirrored current reaches a magnitude of the reference current when the magnitude of the mirrored current is smaller than the magnitude of the reference current.

According to at least some example embodiments, the regulator circuit is configured to decrease a level of the internal power supply voltage, the magnitude of the first current, the magnitude of the second current and a level of a first voltage of the first node when the magnitude of the load current flowing through the power transistor increases and the current source is configured to increase the magnitude of the third current to reduce a returning time of the level of the internal power supply voltage to a previous level before changing, when the magnitude of the load current flowing through the power transistor increases.

According to at least some example embodiments, the regulator circuit is configured to increase a level of the internal power supply voltage, the magnitude of the first current, the magnitude of the second current and a level of a first voltage of the first node when the magnitude of the load current flowing through the power transistor decreases and the current source is configured to decrease the magnitude of the third current to reduce a returning time of the level of the internal power supply voltage to a previous level before changing when the magnitude of the load current flowing through the power transistor decreases.

According to at least example embodiments, the current source includes a first current generator, a second current generator, a third NMOS transistor and a fourth NMOS transistor, a drain of the third NMOS transistor is connected to the fourth node, a gate of the third NMOS transistor is configured to receive a first reference voltage and a source of the third NMOS transistor is connected to a ground voltage supply, a drain of the fourth NMOS transistor is connected to the fourth node, a gate of the fourth NMOS transistor is connected to a fifth node and a source of the fourth NMOS transistor is connected to the ground voltage supply, the first current generator is connected between an external power supply voltage source and the fifth node, the first current generator is configured to generate the reference current based on a second reference voltage and the first current generator is configured to output the reference current to the fifth node, the second current generator is, connected between the fifth node and the ground voltage supply, the second current generator is configured to draw the mirrored current from the fifth node based on the voltage of the third node, and the current source is configured to generate a comparison current based on the mirrored current and the reference current, the current source is configured to apply the comparison current to the gate of the fourth NMOS transistor.

According to at least some example embodiments, the current source is configured to generate a first sub current that flows from the drain of the third NMOS transistor to the source of the third NMOS transistor and a second sub current that flows from the drain of the fourth NMOS transistor to the source of the fourth NMOS transistor, the current source is configured to divide the third current into the first sub current and the second sub current at the fourth node, and the current source is configured to generate the mirrored current such that the magnitude of the mirrored current is inversely proportional to the magnitude of the third current.

According to at least some example embodiments, the first current generator includes a first PMOS transistor, a second PMOS transistor and a fifth NMOS transistor, a source of the first PMOS transistor is configured to receive the external power supply voltage, a gate of the first PMOS transistor is connected to a sixth node and a drain of the first PMOS transistor is connected to the fifth node, the drain of the first PMOS transistor provides the reference current to the fifth node, a source of the second PMOS transistor is configured to receive the external power supply voltage, a gate of the second PMOS transistor is connected to the sixth node and a drain of the second PMOS transistor is connected to the sixth node, a drain of the fifth NMOS transistor is connected to the sixth node, a gate of the fifth NMOS transistor is configured to receive the second reference voltage and a source of the fifth NMOS transistor is connected to the ground voltage supply, and the current source is configured to generate the reference current such that the magnitude of the reference current is proportional to the level of the second reference voltage.

The regulator of claim 7, wherein the second current generator includes a first PMOS transistor, a fifth NMOS transistor and a sixth NMOS transistor, a source of the first PMOS transistor is configured to receive the external power supply voltage, a gate of the third PMOS transistor is configured to receive the voltage of the first node and a drain of the first PMOS transistor is connected to a sixth node, a drain of the fifth NMOS transistor is connected to the sixth node, a gate of the fifth NMOS transistor is connected to the sixth node and a source of the fifth NMOS transistor is connected to the ground voltage supply, a drain of the sixth NMOS transistor is connected to the fifth node, the drain of the NMOS transistor is configured to draw the mirrored current from the fifth node, a gate of the NMOS transistor is connected to the seventh node and a source of the NMOS transistor is connected to the ground voltage supply, and the current source is configured to generate the mirrored current such that the magnitude of the mirrored current is proportional to the level of the voltage of the third node.

The regulator of claim 1, wherein the current mirror includes a first p-channel metal-oxide semiconductor (PMOS) transistor and a second PMOS transistor, a source of the first PMOS transistor is configured to receive the external power supply voltage, a gate of the first PMOS transistor is connected to the third node and a drain of the first PMOS transistor is connected to the first node, the drain of the first PMOS is configured to provide the second current through the first node, a source of the second PMOS transistor is configured to receive the external power supply voltage, a gate of the second PMOS transistor is connected to the third node and a drain of the second PMOS transistor is connected to the third node, the drain of the PMOS is configured to provide the first current through the third node, and the current mirror is configured to operate based on an enable signal.

According to at least some example embodiments, a power system includes a regulator circuit configured to generate an internal power supply voltage based on an external power supply voltage, and an operation circuit configured to perform a given operation based on the internal power supply voltage, the regulator circuit including, a power transistor, a source of the power transistor configured to receive an external power supply voltage, a gate of the power transistor connected to a first node, a first voltage being a voltage of the first node, and a drain of the power transistor connected to a second node, the drain of the power transistor configured to output the internal power supply voltage, a current mirror configured to provide a first current to a third node, a second voltage being a voltage of the third node, the current mirror further configured to provide the first node with a second current having a same magnitude as the first current, a first n-channel metal-oxide semiconductor (NMOS) transistor, a drain of the first NMOS transistor connected to the first node, a gate of the first NMOS transistor configured to receive a first reference voltage and a source of the first NMOS transistor connected to a fourth node, a second NMOS transistor, a drain of the second NMOS transistor connected to the third node, a gate of the second NMOS transistor connected to the second node and a source of the second NMOS transistor connected to the fourth node, and a current source configured to draw a third current from the fourth node, the current source configured to generate a mirrored current having a same magnitude as the first current based on the second voltage, and change a magnitude of the third current based on the mirrored current and a reference current.

According to a least some example embodiments, the current source is configured to increase a voltage adjustment time of the gate of the power transistor to reduce a returning time of a level of the internal power supply voltage to a first level when i) the power transistor changes the level of the internal power supply voltage from the first level to a second level and ii) the regulator circuit changes a magnitude of a load current flowing through the power transistor.

According to at least some example embodiments, the current source is configured to decrease the magnitude of the third current until the magnitude of the mirrored current reaches the magnitude of the reference current, when the magnitude of the mirrored current is greater than a magnitude of the reference current.

According to at least some example embodiments, the current source is configured to increase the magnitude of the third current until the magnitude of the mirrored current reaches the magnitude of the reference current, when the magnitude of the mirrored current is smaller than a magnitude of the reference current.

At least one example embodiment provides a regulator circuit including a power transistor, the power transistor configured to generate an internal power supply voltage based on an external power supply voltage, a gate of the power transistor coupled to a first node, a current mirror configured to output a first current to a second node and a second current to the first node, at least first and second n-channel metal-oxide semiconductor (NMOS) transistors coupled to the first node and the second node, respectively, each of the first and second NMOS transistors having a source connected to a third node and a current source connected between the third node and a ground voltage supply, the current source configured to change a magnitude of a third current from the third node based on the first current and the second current.

In an example embodiment, the current source is configured to generate a mirrored current having a same magnitude as the first current based on a voltage of the second node and change the magnitude of the third current based on a difference between the mirrored current and a reference current.

In an example embodiment, the current source is configured to generate the voltage of the second node.

In an example embodiment, a gate of one of the first and second n-channel metal-oxide semiconductor (NMOS) transistors and a drain of the power transistor are connected at a common node.

In an example embodiment, the current source includes a current generation circuit configured to generate a fourth current based on the external power supply voltage and a first reference voltage, a third NMOS transistor, a gate of the third NMOS transistor configured to receive the fourth current, a drain of the third NMOS transistor configured to receive a first portion of the third current and a source of the third NMOS transistor connected to the ground voltage supply and a fourth NMOS transistor, a gate of the fourth NMOS transistor configured to receive a second reference voltage, a drain of the fourth NMOS transistor configured to receive a second portion of the third current and a source of the fourth NMOS transistor connected to the ground voltage supply.

BRIEF DESCRIPTION OF THE DRAWINGS

Illustrative, non-limiting example embodiments will be more clearly understood from the following detailed description in conjunction with the accompanying drawings.

DETAILED DESCRIPTION

Figure 1:
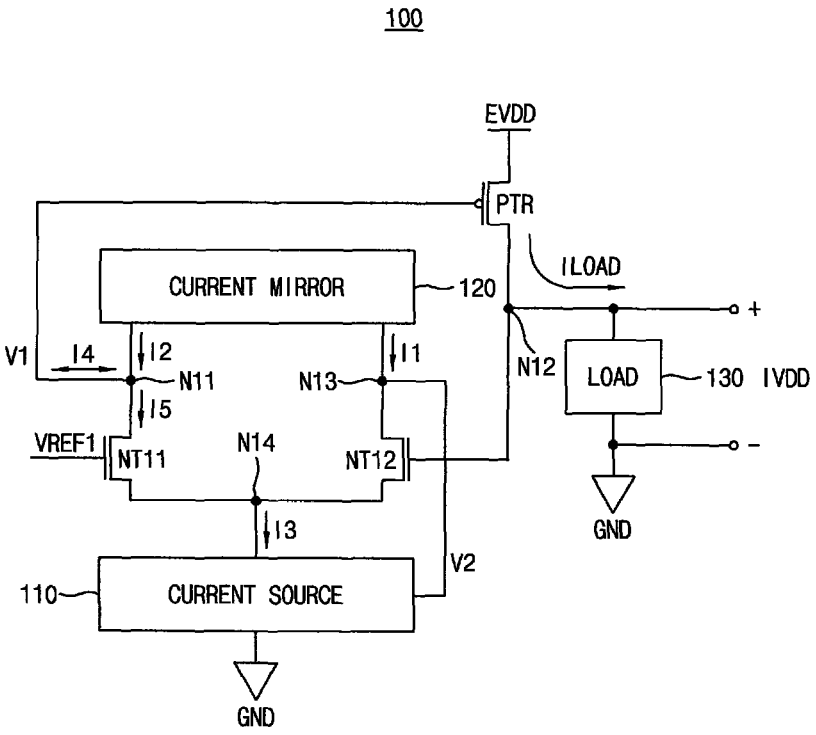
FIG. 1 illustrates a regulator circuit according to at least one example embodiment.

Various example embodiments will be described more fully hereinafter with reference to the accompanying drawings, in which some example embodiments are shown. The present disclosure may, however, be embodied in many different forms and should not be construed as limited to the example embodiments set forth herein. Rather, these example embodiments are provided so that this disclosure will be thorough and complete, and will fully convey the scope of the present disclosure to those skilled in the art. In the drawings, the sizes and relative sizes of layers and regions may be exaggerated for clarity. Like numerals refer to like elements throughout.

It will be understood that, although the terms first, second, third etc, may be used herein to describe various elements, these elements should not be limited by these terms. These terms are used to distinguish one element from another. Thus, a first element discussed below could be termed a second element without departing from the teachings of the present disclosure. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the present disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 illustrates a regulator circuit according to at least one example embodiment.

Referring to FIG. 1, a regulator circuit 100 includes a power transistor PTR, a current mirror 120, a first n-channel metal-oxide semiconductor (NMOS) transistor NT11, a second NMOS transistor NT12 and a current source 110. A load 130 may be coupled to the second NMOS transistor NT12 and the power transistor PTR.

The power transistor PTR has a source connected to an external power supply voltage EVDD, a gate connected to a first node N11 having a first voltage V1 and a drain connected to a second node N12 that outputs an internal power supply voltage IVDD. The load 130 is connected between the second node N12 and a ground voltage GND. A load current ILOAD may flow from the source to the drain of the power transistor PTR. That is, the load current ILOAD may flow through the power transistor PTR. Almost all the entire load current ILOAD flows to the load 130 because a little portion of the load current ILOAD flows into a gate of the second NMOS transistor NT12. A magnitude of the load current ILOAD may change as a time elapses.

The current mirror 120 provides a first current I1 to a third node N13 having a second voltage V2 and provides the first node N11 with a second current I2 having a same magnitude as the first current I1. The current mirror 120 will be described later with reference to FIGS. 5 and 6.

The first NMOS transistor NT11 has a drain connected to the first node N11, a gate receiving a first reference voltage VREF1 and a source connected to a fourth node N14. The second NMOS transistor NT12 has a drain connected to the third node N13, a gate connected to the second node N12 and a source connected to the fourth node N14. The current source 110 is connected to the third node N13, the fourth node N14 and the ground voltage GND, draws a third current I3 from the fourth node N14, generates a mirrored current having a same magnitude as the first current I1 based on the second voltage V2 and changes a magnitude of the third current I3 based on a difference between the mirrored current and a reference current. The current source 110 will be described later with reference to FIGS. 2 through 4.

In some example embodiments, when a level of the internal power supply voltage IVDD is changed from a first level to a second level different from the first level as a magnitude of the load current ILOAD is changed, the current source 110 may increase a charging/discharging time of the gate of the power transistor PTR to reduce a returning time of the internal power supply voltage IVDD to the first level by temporarily adjusting the third current I3.

When the magnitude of the load current ILOAD decreases, a voltage drop between the source and the drain of the power transistor PTR decreases, and the level of the internal power supply voltage IVDD increases. As a voltage difference between the gate and the source of the second NMOS transistor NT12 increases, the magnitude of the first current I1 increases. When the mirrored current corresponding to the first current I1 is greater than the reference current, the current source 110 may decrease the magnitude of the third current I3 until the magnitude of the mirrored current is same as the magnitude of the reference current. Since the second current I2 is the same as the first current I1 and a fifth current I5 decreases due to the decrease of the third current I3, the magnitude of a fourth current I4, flowing from the first node N11 to the gate of the power transistor PTR increases. Since the magnitude of the second current I2 increases, the level of the first voltage V1 also increases. Since the gate of the power transistor PTR is charged with the increased fourth current I4, a gate voltage of the power transistor PTR reaches the level of the first voltage V1 that increases rapidly and the level of the internal power supply voltage IVDD decreases to return to a level corresponding to a level that the internal power supply voltage IVDD has before the internal power supply voltage IVDD increases.

When the magnitude of the load current ILOAD increases, the voltage drop between the source and the drain of the power transistor PTR increases, and the level of the internal power supply voltage IVDD decreases. As the voltage difference between the gate and the source of the second NMOS transistor NT12 decreases, the magnitude of the first current I1 decreases. When the mirrored current corresponding to the first current I1 is smaller than the reference current, the current source 110 may increase the magnitude of the third current I3 until the magnitude of the mirrored current is same as the magnitude of the reference current. Since the second current I2 is the same as the first current I1 and the fifth current I5 increases due to the increase of the third current I3, the magnitude of the fourth current I4, flowing from the gate of the power transistor PTR to the first node N11 increases. Since the magnitude of the second current I2 decreases, the level of the first voltage V1 also decreases. Since the gate of the power transistor PTR is discharged through the increased fourth current I4, the gate voltage of the power transistor PTR reaches the level of the first voltage V1 that decreases rapidly and the level of the internal power supply voltage IVDD increases to return to a level corresponding to a level that the internal power supply voltage IVDD has before the internal power supply voltage IVDD decreases. The reference current will be described later with reference to FIGS. 2 through 4.

Figure 2:
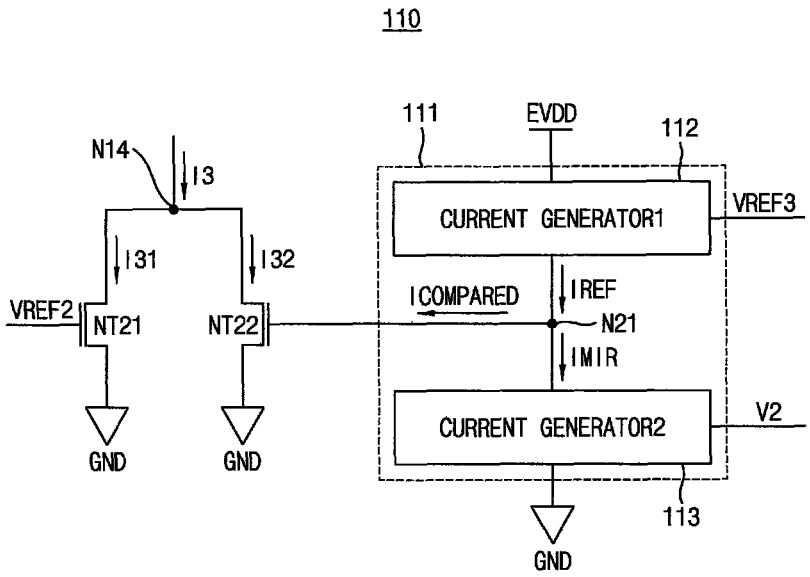
FIG. 2 illustrates a current source in the regulator circuit of FIG. 1 according to at least one example embodiment.

FIG. 2 illustrates the current source in the regulator circuit of FIG. 1 according to at least one example embodiment.

Referring to FIG. 1, the current source 110 includes a current generation unit 111, a third NMOS transistor NT21 and a fourth NMOS transistor NT22. The current generation unit 111 includes a first current generator 112 and a second current generator 113.

The third NMOS transistor NT21 has a drain connected to the fourth node N14, a gate receiving a second reference voltage VREF2 and a source connected to the ground voltage GND. The fourth NMOS transistor NT22 has a drain connected to the fourth node N14, a gate connected to a fifth node N21 and a source connected to the ground voltage GND. The second reference voltage VREF2 may have a fixed level.

A first sub current I31 flows from the drain to the source of the third NMOS transistor NT21 and a second sub current I32 from the drain to the source of the fourth NMOS transistor NT22. The third current I3 may be divided into the first sub current I31 and the second sub current I32 at the fourth node N14.

The first current generator 112 is connected between the external power supply voltage EVDD and the fifth node N21, generates a reference current IREF based on a third reference voltage VREF3 and outputs the reference current IREF to the fifth node N21. The second current generator 113 is connected between the fifth node N21 and the ground voltage GND and draws a mirrored current IMIR from the fifth node N21 based on the second voltage V2. A comparison current ICOMPARED corresponding to a current obtained by subtracting the mirrored current IMIR from the reference current IREF is provided to the gate of the fourth NMOS transistor NT22.

A magnitude of the mirrored current IMIR may be inversely proportional to the magnitude of the third current I3. The magnitude of the mirrored current IMIR may be inversely proportional to a magnitude of the second sub current I32. When the level of the internal power supply voltage IVDD decreases and the magnitude of the first current I1 decreases, the magnitude of the mirrored current IMIR decreases and a magnitude of the comparison current ICOMPARED increases. Accordingly, the gate voltage of the fourth NMOS transistor NT22 increases and the magnitudes of the second sub current I32 and the third current I3 increases. On the contrary, when the level of the internal power supply voltage IVDD increases and the magnitude of the first current I1 increases, the magnitude of the mirrored current IMIR increases and the magnitude of the comparison current ICOMPARED decreases. Accordingly, the gate voltage of the fourth NMOS transistor NT22 decreases and the magnitudes of the second sub current I32 and the third current I3 decreases.

Figure 3:
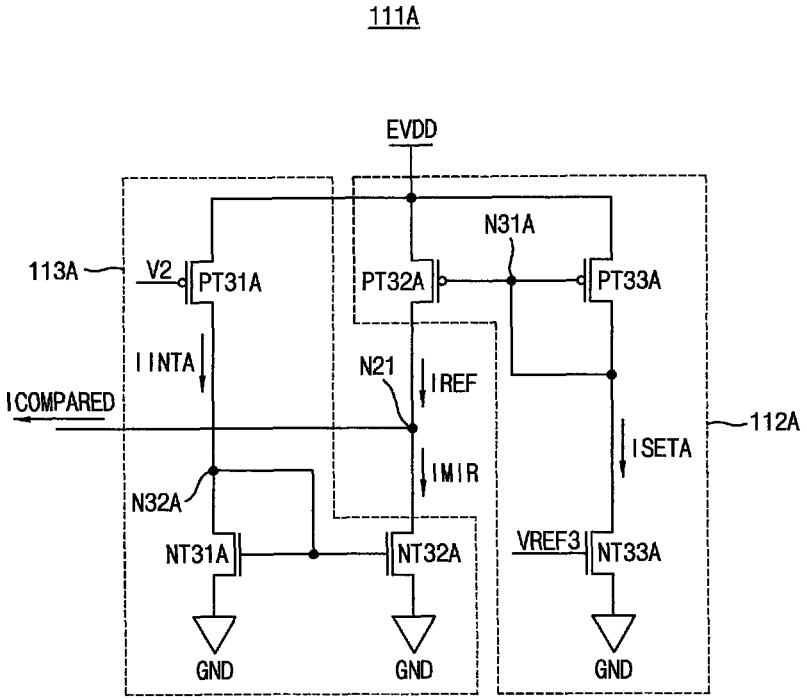
FIG. 3 is a circuit diagram illustrating an example of a current generation unit in the current source of FIG. 2 according to at least one example embodiment.

FIG. 3 is a circuit diagram illustrating an example of the current generation unit in the current source of FIG. 2 according to at least one example embodiment.

Referring to FIG. 3, a current generation unit 111A includes a first current generator 112A and a second current generator 113A. The second current generator 113A includes a first p-channel metal-oxide semiconductor (PMOS) transistor PT31A, a first NMOS transistor NT31A and a second NMOS transistor NT32A. The first current generator 112A includes a second PMOS transistor PT32A, a third PMOS transistor PT33A and a third NMOS transistor NT33A.

The first PMOS transistor PT31A has a source connected to the external power supply voltage EVDD, a gate receiving the second voltage V2 and a drain connected to a node N32A. The second PMOS transistor PT32A has a source connected to the external power supply voltage EVDD, a gate connected to a node N31A and a drain, connected to the fifth node N21, that provides the reference current IREF to the fifth node N21. The third PMOS transistor PT33A has a source connected to the external power supply voltage EVDD, a gate connected to the node N31A and a drain connected to the node N31A.

The first NMOS transistor NT31A has a drain connected to the node N32A, a gate connected to the node N32A and a source connected to the ground voltage GND. The second NMOS transistor NT32A has a drain, connected to the fifth node N21, which draws the mirrored current IMIR from the fifth node N21, a gate connected to the node N32A and a source connected to the ground voltage GND. The third NMOS transistor NT33A has a drain connected to the node N31A, a gate receiving the third reference voltage VREF3 and a source connected to the ground voltage GND.

Since the third NMOS transistor NT33A generates a set current ISETA based on the third reference voltage VREF3 and the second and third PMOS transistors PT32A and PT33A operate as a current mirror, a magnitude of the reference current IREF is same as a magnitude of the set current ISETA. Therefore, the magnitude of the reference current IREF may be proportional to the level of the third reference voltage VREF3.

Since the first PMOS transistor PT31A generates an internal current IINTA in response to the second voltage V2 and the first NMOS transistor NT31A and the second NMOS transistor NT32A operate as a current mirror, a magnitude of the mirrored current IMIR is same as the magnitude of the internal current IINTA. Therefore, the magnitude of the mirrored current IMIR may be proportional to the level of the second voltage V2.

When the magnitude of the mirrored current IMIR is greater than the magnitude of the reference current IREF, the current source 111A decreases the magnitude of the comparison current ICOMPARED until the magnitude of the mirrored current IMIR reaches the magnitude of the reference current IREF, and thus decreases the magnitudes the first current I1 and the mirrored current IMIR.

When the magnitude of the mirrored current IMIR is smaller than the magnitude of the reference current IREF, the current source 111A increases the magnitude of the comparison current ICOMPARED until the magnitude of the mirrored current reaches the magnitude of the reference current IREF, and thus increases the magnitudes the first current I1 and the mirrored current IMIR.

Figure 4:
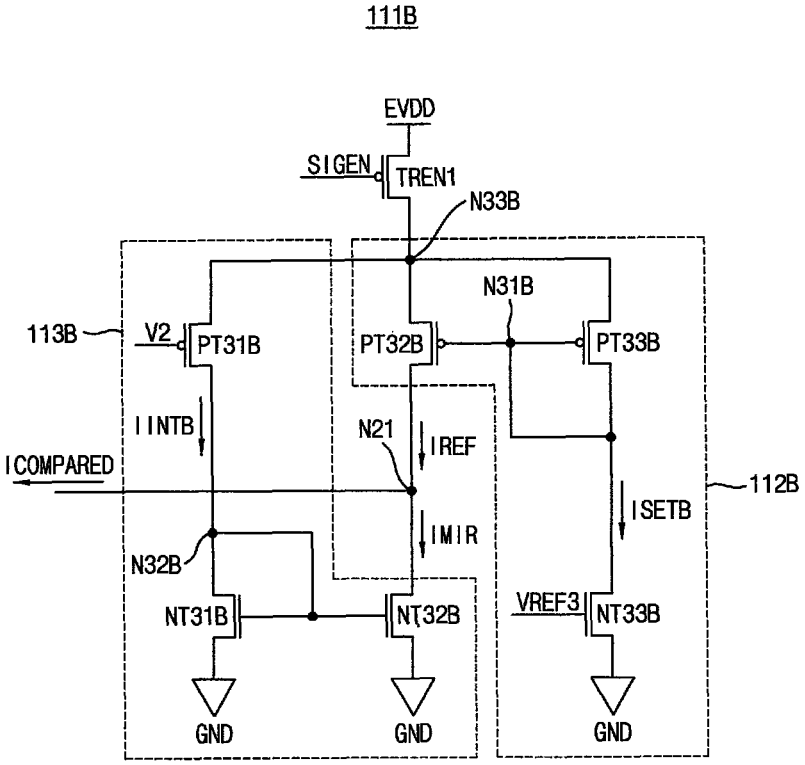
FIG. 4 is a circuit diagram illustrating another example of the current generation unit in the current source of FIG. 2 according to at least one example embodiment.

FIG. 4 is a circuit diagram illustrating another example of the current generation unit in the current source of FIG. 2 according to at least one example embodiment.

Referring to FIG. 4, a current generation unit 111B includes an enable transistor TREN1, a first current generator 112B and a second current generator 113B.

The second current generator 113B includes a first p-channel metal-oxide semiconductor (PMOS) transistor PT31B, a first NMOS transistor NT31B and a second NMOS transistor NT32B. The first current generator 112B includes a second PMOS transistor PT32B, a third PMOS transistor PT33B and a third NMOS transistor NT33B.

The enable transistor TREN1 has a source connected to the external power supply voltage EVDD, a gate receiving an enable signal SIGEN and a drain connected to a node N33B. The first PMOS transistor PT31B has a source connected to the node N33B, a gate receiving the second voltage V2 and a drain connected to a node N32B. The second PMOS transistor PT32B has a source connected to the node N33B, a gate connected to a node N31B and a drain, connected to the fifth node N21, that provides the reference current IREF to the fifth node N21. The third PMOS transistor PT33B has a source connected to the node N33B, a gate connected to the node N31B and a drain connected to the node N31B.

The first NMOS transistor NT31B has a drain connected to the node N32B, a gate connected to the node N32B and a source connected to the ground voltage GND. The second NMOS transistor NT32B has a drain, connected to the fifth node N21, which draws the mirrored current IMIR from the fifth node N21, a gate connected to the node N32B and a source connected to the ground voltage GND. The third NMOS transistor NT33B has a drain connected to the node N31B, a gate receiving the third reference voltage VREF3 and a source connected to the ground voltage GND.

Since the third NMOS transistor NT33B generates a set current ISETB based on the third reference voltage VREF3 and the second and third PMOS transistors PT32B and PT33B operate as a current mirror, a magnitude of the reference current IREF is same as a magnitude of the set current ISETB. Therefore, the magnitude of the reference current IREF may be proportional to the level of the third reference voltage VREF3.

Since the first PMOS transistor PT31B generates an internal current IINTA in response to the second voltage V2 and the first NMOS transistor NT31B and the second NMOS transistor NT32B operate as a current mirror, a magnitude of the mirrored current IMIR is same as the magnitude of the internal current IINTA. Therefore, the magnitude of the mirrored current IMIR may be proportional to the level of the second voltage V2.

When the magnitude of the mirrored current IMIR is greater than the magnitude of the reference current IREF, the current source 111B decreases the magnitude of the comparison current ICOMPARED until the magnitude of the mirrored current IMIR reaches the magnitude of the reference current IREF, and thus decreases the magnitudes the first current I1 and the mirrored current IMIR.

When the magnitude of the mirrored current IMIR is smaller than the magnitude of the reference current IREF, the current source 111B increases the magnitude of the comparison current ICOMPARED until the magnitude of the mirrored current IMIR reaches the magnitude of the reference current IREF, and thus increases the magnitudes the first current I1 and the mirrored current IMIR.

In addition, the current generation unit 111B is activated, when the enable signal SIGEN has a logic low level.

Figure 5:
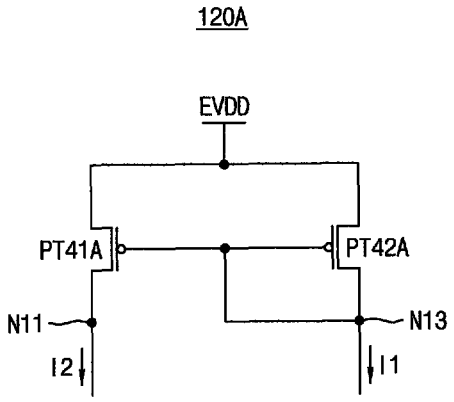
FIG. 5 is a circuit diagram illustrating an example of a current mirror in the regulator circuit of FIG. 1 according to at least one example embodiment.

FIG. 5 is a circuit diagram illustrating an example of the current mirror in the regulator circuit according to at least one example embodiment.

Referring to FIG. 5, a current mirror 120A includes a first PMOS transistor PT41A and a second PMOS transistor PT42A.

The first PMOS transistor PT41A has a source connected to the external power supply voltage EVDD, a gate connected to the third node N13 and a drain, connected to the first node N11, which provides the second current I2 through the first node N11. The second PMOS transistor PT42A has source connected to the external power supply voltage EVDD, a gate connected to the third node N13 and a drain, connected to the third node N13, which provides the first current I1 through the third node N13.

When a size of the first PMOS transistor PT41A is same as a size of the second PMOS transistor PT42A, the current mirror 120A generates the second current I2 by mirroring the first current I1. That is, the magnitude of the first current I1 is same as the magnitude of the second current I2.

Figure 6:
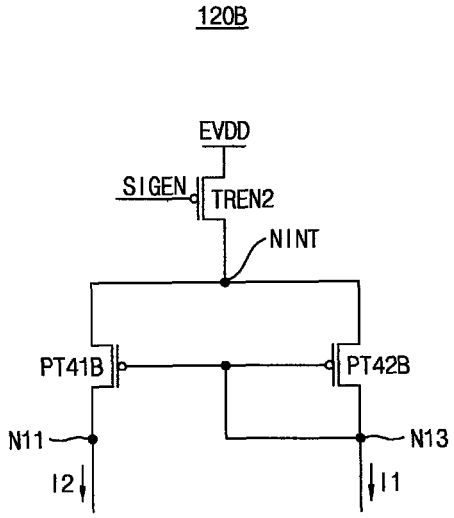
FIG. 6 is a circuit diagram illustrating another example of the current mirror in the regulator circuit of FIG. 1 according to at least one example embodiment.

FIG. 6 is a circuit diagram illustrating another example of the current mirror in the regulator circuit according to at least one example embodiment.

Referring to FIG. 6, a current mirror 120B includes an enable transistor TREN2, first PMOS transistor PT41B and a second PMOS transistor PT42B.

The enable transistor TREN2 has a source connected to the external power supply voltage EVDD, a gate receiving the enable signal SIGEN and a drain connected to an internal node NINT. The first PMOS transistor PT41B has a source connected to the internal node NINT, a gate connected to the third node N13 and a drain, connected to the first node N11, which provides the second current I2 through the first node N11. The second PMOS transistor PT42A has source connected to the internal node NINT, a gate connected to the third node N13 and a drain, connected to the third node N13, which provides the first current I1 through the third node N13.

When a size of the first PMOS transistor PT41B is same as a size of the second PMOS transistor PT42B, the current mirror 120B generates the second current I2 by mirroring the first current I1. That is, the magnitude of the first current I1 is same as the magnitude of the second current I2.

FIGS. 7 through 10 respectively illustrate waveforms of the operation of the regulator circuit of FIG. 1 according to at least one example embodiment.

Figure 7:
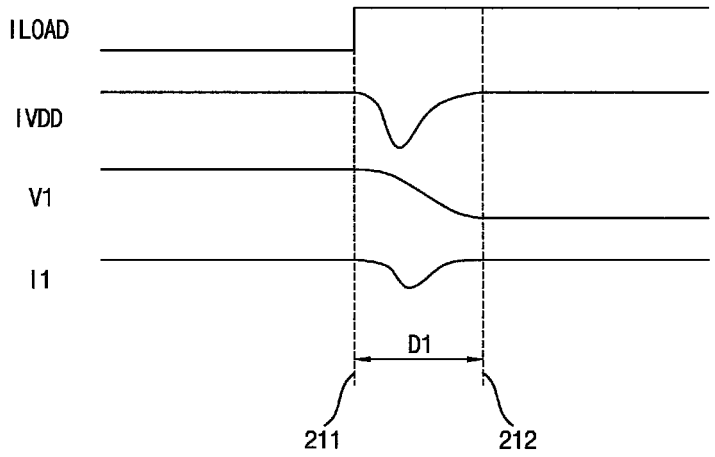
FIGS. 7 through 10 respectively illustrate waveforms of the operation of the regulator circuit of FIG. 1 according to at least one example embodiment.
Figure 8:
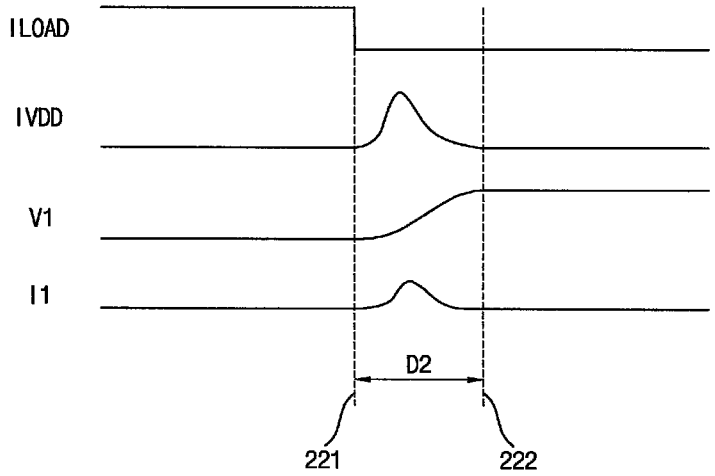

FIGS. 7 and 8 illustrate examples when the fourth NMOS transistor NT22 does not operate.

Referring to FIGS. 1 and 7, when the magnitude of the load current ILOAD increases at a first time point 211, the voltage drop between the source and the drain of the power transistor PTR increases and the level of the internal power supply voltage IVDD decreases. As the voltage difference between the gate and the source of the second NMOS transistor NT12 decreases, the magnitudes of the first current I1 and the second current I2 decrease. Since a capacitance of the gate of the power transistor PTR is high, the level of the first voltage V1 decreases until a second time point 212. An interval from the first time point 211 to the second time point 212 may be referred to as a first delay time D1. After the first delay time D1 elapses, the level of the internal power supply voltage IVDD and the magnitude of the first current I1 return to their initial value before the first time point 211 respectively.

The third NMOS transistor NT21 is activated in the current source 110, the third current I3 only includes the first sub current I31 determined by the second reference voltage VREF2 that has a fixed level, the first delay time D1 is long and it takes a long time for the regulator circuit 100 to be stabilized.

Referring to FIGS. 1 and 8, when the magnitude of the load current ILOAD decreases at a first time point 221, the voltage drop between the source and the drain of the power transistor PTR decreases and the level of the internal power supply voltage IVDD increases. As the voltage difference between the gate and the source of the second NMOS transistor NT12 increases, the magnitudes of the first current I1 and the second current I2 increase. Since a capacitance of the gate of the power transistor PTR is high, the level of the first voltage V1 increases until a second time point 222. An interval from the first time point 221 to the second time point 222 may be referred to as a second delay time D2. After the second delay time D2 elapses, the level of the internal power supply voltage IVDD and the magnitude of the first current I1 return to their initial value before change respectively.

The third NMOS transistor NT21 is activated in the current source 110, the third current I3 only includes the first sub current I31 determined by the second reference voltage VREF2 that has a fixed level, the second delay time D2 is long and it takes a long time for the regulator circuit 100 to be stabilized.

Figure 9:
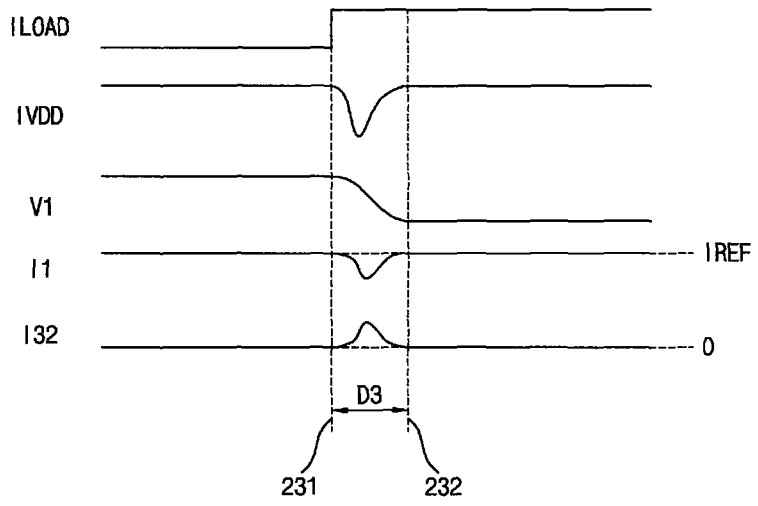
Figure 10:
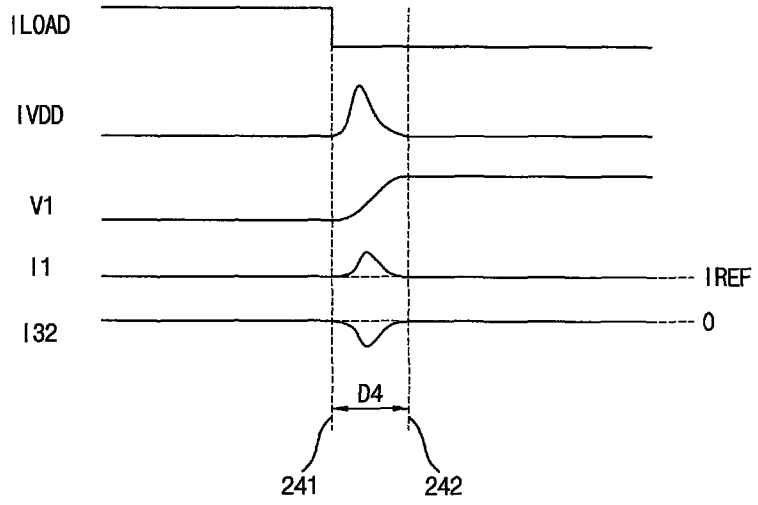

FIGS. 9 and 10 illustrate examples when all of the components of the current source 110 of FIG. 2 operate.

Referring to FIGS. 1 and 9, when the magnitude of the load current ILOAD increases at a first time point 231, the voltage drop between the source and the drain of the power transistor PTR increases and the level of the internal power supply voltage IVDD decreases. As the voltage difference between the gate and the source of the second NMOS transistor NT12 decreases, the magnitudes of the first current I1 and the second current I2 decrease. Since the capacitance of the gate of the power transistor PTR is high, the level of the first voltage V1 decreases until a second time point 232. An interval from the first time point 231 to the second time point 232 may be referred to as a third delay time D3. After the third delay time D3 elapses, the level of the internal power supply voltage IVDD and the magnitude of the first current I1 return to their initial value before change respectively.

When the magnitude of the first current I1 decreases, the magnitude of the mirrored current IMIR decreases and the magnitudes of the second sub current I32 and the third current I3 increase. Therefore, the third delay time D3 is shorter than the first delay time D1 or the second delay time D2 and it takes a shorter time for the regulator circuit 100 to be stabilized. Since the magnitude of the second sub current I32 temporarily increases and returns to its initial value, additional power consumption of the current source 110 may be minimized.

Referring to FIGS. 1 and 10, when the magnitude of the load current ILOAD decreases at a first time point 241, the voltage drop between the source and the drain of the power transistor PTR decreases and the level of the internal power supply voltage IVDD increases. As the voltage difference between the gate and the source of the second NMOS transistor NT12 increases, the magnitudes of the first current I1 and the second current I2 increase. Since the capacitance of the gate of the power transistor PTR is high, the level of the first voltage V1 increases until a second time point 242. An interval from the first time point 241 the second time point 242 may be referred to as a fourth delay time D4. After the fourth delay time D4 elapses, the level of the internal power supply voltage IVDD and the magnitude of the first current return to their initial value before change respectively.

When the magnitude of the first current I1 increases, the magnitude of the mirrored current IMIR increases and the magnitudes of the second sub current I32 and the third current I3 decrease. Therefore, the third fourth time D4 is shorter than the first delay time D1 or the second delay time D2 and it takes shorter time for the regulator circuit 100 to be stabilized. Since the magnitude of the second sub current I32 temporarily increases and returns to its initial value, additional power consumption of the current source 110 may be minimized.

Figure 11:
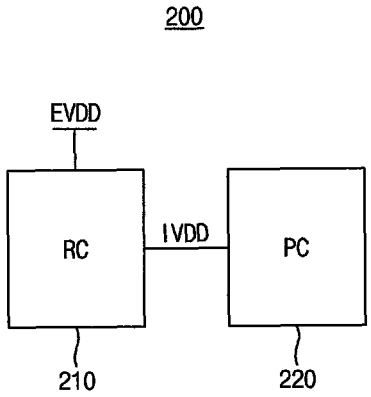
FIG. 11 is a block diagram illustrating a power system according to at least one example embodiment.

FIG. 11 is a block diagram illustrating a power system according to at least one example embodiment.

Referring to FIG. 11, a power system 200 includes a regulator circuit 210 and an operation circuit The regulator circuit 210 generates an internal power supply voltage IVDD based on an external power supply voltage EVDD. The operation circuit 220 may perform a given operation based on the internal power supply voltage IVDD.

The regulator circuit 210 may employ the regulator circuit 100 of FIG. 1. Therefore, the regulator circuit 210 may include a power transistor, a current mirror, a first NMOS transistor, a second NMOS transistor and a current source. The power transistor has a source connected to the external power supply voltage EVDD, a gate connected to a first node having a first voltage and a drain connected to a second node that outputs the internal power supply voltage. The current mirror provides a first current to a third node having a second voltage and provides the first node with a second current having a same magnitude as the first current. The first NMOS transistor has a drain connected to the first node, a gate receiving a reference voltage and a source connected to a fourth node. The second NMOS transistor has a drain connected to the third node, a gate connected to the second node and a source connected to the fourth node. The current source is connected to the third node, the fourth node and the ground voltage, draws a third current from the fourth node generates a mirrored current having a same magnitude as the first current based on the second voltage and changes a magnitude of the third current based on a difference between the mirrored current and a reference current.

When a level of the internal power supply voltage is changed from a first level to a second level different from the first level as a magnitude of a load current ILOAD flowing from the source to the drain of the power transistor is changed, the current source may increase a charging/discharging time of the gate of the power transistor to reduce a returning time of the level of the internal power supply voltage IVDD to the first level by temporarily adjusting the third current.

The regulator circuit 210 may be fully understood with reference to FIGS. 1 through 10.

Figure 12:
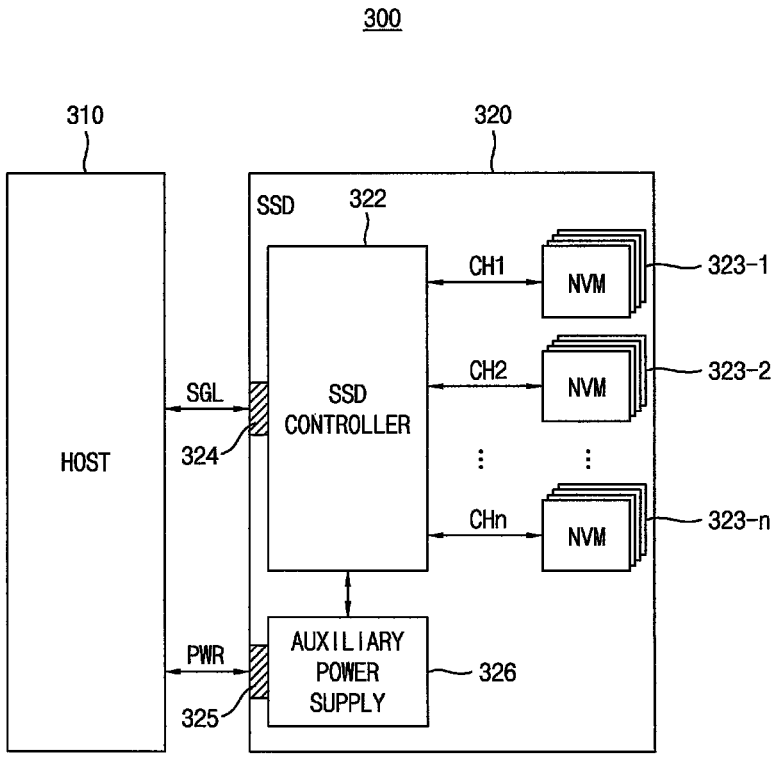
FIG. 12 is a block diagram illustrating a solid state drive (SSD) system according to at least one example embodiment.

FIG. 12 is a block diagram illustrating a solid state drive (SSD) system according to at least one example embodiment.

Referring to FIG. 12, an SSD system 300 includes a host 310 and an SSD 320. The SSD 320 includes first through n-th non-volatile memory devices 323-1, 323-2, or 323-n and a SSD controller 322. Here, n represents an integer greater than or equal to 2. The first through n-th non-volatile memory devices 323-1 323-2, or 323-n may be used as a storage medium of the SSD 320.

Each of the first through n-th non-volatile memory devices 323-1, 323-2, or 323-n may include a memory cell array formed on a substrate with a three-dimensional structure. Memory cells included in the memory cell array may be formed in a direction perpendicular to the substrate. The memory cells included in the memory cell array may be connected to a plurality of word lines, which are stacked in a direction perpendicular to the substrate, and a plurality of bit lines, which are formed in a direction parallel to the substrate.

The SSD controller 322 is coupled to the first through n-th non-volatile memory devices 323-1, 323-2, or 323-n through first to n-th channels CH1, CH2, to CHn, respectively.

The SSD controller 322 exchanges a signal SGL with the host 310 through a signal connector 324. The signal SGL may include a command, an address and data. The SSD controller 322 may perform a program operation and a read operation on the first through n-th non-volatile memory devices 323-1, 323-2, or 323-n according to the command received from the host 310.

The SSD 320 may further include an auxiliary power supply 326. The auxiliary power supply 126 may receive a power PWR from the host 310 through a power connector 325 and provide a power to the SSD controller 322. The auxiliary power supply 326 may be placed inside or outside the SSD 320. For example, the auxiliary power supply 326 may be placed in a main board and provide auxiliary power to the SSD 320.

The auxiliary power supply 326 may include the regulator circuit of FIG. 1.

Figure 13:
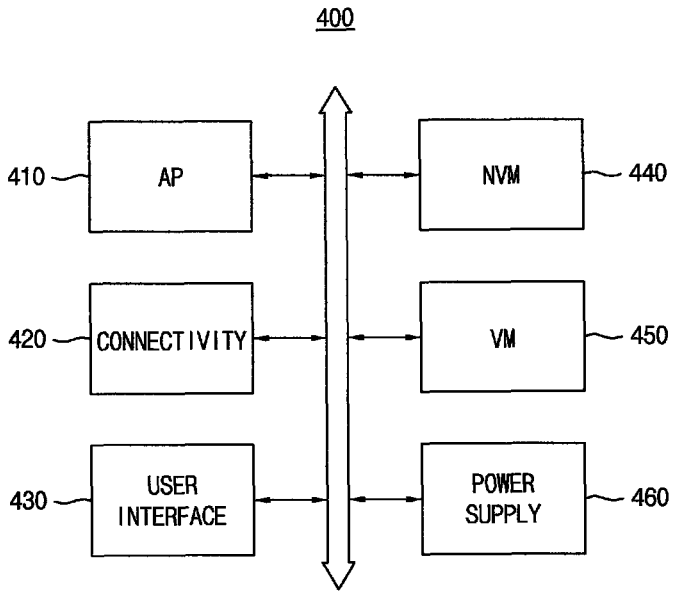
FIG. 13 is a block diagram illustrating a mobile system according to at least one example embodiment.

FIG. 13 is a block diagram illustrating a mobile system according to at least one example embodiment.

Referring to FIG. 13, a mobile system 400 includes an application processor 410, a connectivity unit 420, a user interface 430, a non-volatile memory device 440, a volatile memory device 450 and a power supply 460.

In at least one example embodiment, the mobile system 400 may be a mobile phone, a smart phone, a personal digital assistant (PDA), a portable multimedia player (PMP), a digital camera, a music player, a portable game console, a navigation system, etc.

The application processor 410 may execute applications, such as a web browser, a game application, a video player, etc. In some example embodiments, the application processor 410 may include a single core or multiple cores. For example, the application processor 410 may be a multi-core processor, such as a dual-core processor, a quad-core processor, a hexa-core processor, etc. The application processor 410 may include an internal or external cache memory.

The connectivity unit 420 may perform wired or wireless communication with an external device. For example, the connectivity unit 420 may perform Ethernet communication, near field communication (NFC), radio frequency identification (RFID) communication, mobile telecommunication, memory card communication, universal serial bus (USB) communication, etc. In at least one example embodiment, the connectivity unit 420 may include a baseband chipset that supports communications, such as global system for mobile communications (GSM), general packet radio service (GPRS), wideband code division multiple access (WCDMA), high speed downlink/uplink packet access (HSxPA), etc.

The non-volatile memory device 440 may store a boot image for booting the mobile system 400.

The non-volatile memory device 440 may include a memory cell array formed on a substrate in a three-dimensional structure. Memory cells included in the memory cell array may be formed in a direction perpendicular to the substrate. The memory cells included in the memory cell array may be connected to a plurality of word lines, which are stacked in a direction perpendicular to the substrate, and a plurality of bit lines, which are formed in a direction parallel to the substrate.

The volatile memory device 450 may store data processed by the application processor 410, or may operate as a working memory.

The user interface 430 may include at least one input device, such as a keypad, a touch screen, etc., and at least one output device, such as a speaker, a display device, etc.

The power supply 460 may supply an operating voltage to the mobile system 400. The power supply includes a regulator circuit. The regulator circuit may employ the regulator circuit 100 of FIG. 1. The regulator circuit may employ the regulator circuit 210 in FIG. 11 and the application processor 410, the connectivity unit 420, the user interface 430, the non-volatile memory device 440 and the volatile memory device 450 may correspond to the operation circuit 220 in FIG. 11.

In at least one example embodiment, the mobile system 400 may further include an image processor, and/or a storage device, such as a memory card, a solid state drive (SSD), a hard disk drive (HDD), a CD-ROM, etc.

In at least one example embodiment, the mobile system 400 and/or components of the mobile system 400 may be packaged in various forms, such as package on package (PoP), ball grid arrays (BGAs), chip scale packages (CSPs), plastic leaded chip carrier (PLCC), plastic dual in-line package (PDIP), die in waffle pack, die in wafer form, chip on board (COB), ceramic dual in-line package (CERDIP), plastic metric quad flat pack (MQFP), thin quad flat pack (TQFP), small outline IC (SOIC), shrink small outline package (SSOP), thin small outline package (TSOP), system in package (SIP), multi-chip package (MCP), wafer-level fabricated package (WFP), or wafer-level processed stack package (WSP).

The present disclosure may be applied to various electronic devices including a regulator circuit. For example, the present disclosure may be applied to systems such as a mobile phone, a smart phone, a personal digital assistant (PDA), a portable multimedia player (PMP), a digital camera, a camcorder, personal computer (PC), a server computer, a workstation, a laptop computer, a digital TV, a set-top box, a portable game console, a navigation system, etc.

The foregoing is illustrative of at least one example embodiment and is not to be construed as limiting thereof. Although a few example embodiments have been described, those skilled in the art will readily appreciate that many modifications are possible in the example embodiments without materially departing from the novel teachings and advantages of the present disclosure. Accordingly, all such modifications are intended to be included within the scope of the present disclosure as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A regulator circuit comprising:

a power transistor, a source of the power transistor configured to receive an external power supply voltage, a gate of the power transistor connected to a first node and a drain of the power transistor connected to a second node, the power transistor configured to generate an internal power supply voltage;

a current mirror configured to provide a first current to a third node, and the current mirror further configured to provide the first node with a second current, the second current having a same magnitude as the first current;

a first n-channel metal-oxide semiconductor (NMOS) transistor, a drain of the first NMOS transistor connected to the first node and a source of the first NMOS transistor connected to a fourth node;

a second NMOS transistor, a drain of the second NMOS transistor connected to the third node, a gate of the second NMOS transistor connected to the second node and a source of the second NMOS transistor connected to the fourth node; and a current source configured to draw a third current from the fourth node, the current source configured to generate a mirrored current having a same magnitude as the first current based on a voltage of the third node and configured to change a magnitude of the third current based on a difference between the mirrored current and a reference current.

2. The regulator circuit of claim 1, wherein the current source is configured to increase a voltage adjustment time of the gate of the power transistor to reduce a returning time of a level of the internal power supply voltage to a first level, when i) the power transistor changes the level of the internal power supply voltage from the first level to a second level and ii) the regulator circuit changes a magnitude of a load current flowing through the power transistor.

3. The regulator circuit of claim 1, wherein the current source is configured to decrease the magnitude of the third current until the magnitude of the mirrored current reaches a magnitude of the reference current when the magnitude of the mirrored current is greater than the magnitude of the reference current.

4. The regulator circuit of claim 1, wherein, the current source is configured to increase the magnitude of the third current until the magnitude of the mirrored current reaches a magnitude of the reference current when the magnitude of the mirrored current is smaller than the magnitude of the reference current.

5. The regulator circuit of claim 1, wherein the regulator circuit is configured to decrease a level of the internal power supply voltage, the magnitude of the first current, the magnitude of the second current and a level of a first voltage of the first node when a magnitude of a load current flowing through the power transistor increases and the current source is configured to increase the magnitude of the third current to reduce a returning time of the level of the internal power supply voltage to a previous level before changing, when the magnitude of the load current flowing through the power transistor increases.

6. The regulator circuit of claim 1, wherein the regulator circuit is configured to increase a level of the internal power supply voltage, the magnitude of the first current, the magnitude of the second current and a level of a first voltage of the first node when a magnitude of a load current flowing through the power transistor decreases and the current source is configured to decrease the magnitude of the third current to reduce a returning time of the level of the internal power supply voltage to a previous level before changing when the magnitude of the load current flowing through the power transistor decreases.

7. The regulator circuit of claim 1, wherein the current source includes a first current generator, a second current generator, a third NMOS transistor and a fourth NMOS transistor, a drain of the third NMOS transistor is connected to the fourth node, a gate of the third NMOS transistor is configured to receive a first reference voltage and a source of the third NMOS transistor is connected to a ground voltage supply, a drain of the fourth NMOS transistor is connected to the fourth node, a gate of the fourth NMOS transistor is connected to a fifth node and a source of the fourth NMOS transistor is connected to the ground voltage supply, the first current generator is connected between an external power supply voltage source and the fifth node, the first current generator is configured to generate the reference current based on a second reference voltage and the first current generator is configured to output the reference current to the fifth node, the second current generator is, connected between the fifth node and the ground voltage supply, the second current generator is configured to draw the mirrored current from the fifth node based on the voltage of the third node, and the current source is configured to generate a comparison current based on the mirrored current and the reference current, and the current source is configured to apply the comparison current to the gate of the fourth NMOS transistor.

8. The regulator circuit of claim 7, wherein the current source is configured to generate a first sub current that flows from the drain of the third NMOS transistor to the source of the third NMOS transistor and a second sub current that flows from the drain of the fourth NMOS transistor to the source of the fourth NMOS transistor, the current source is configured to divide the third current into the first sub current and the second sub current at the fourth node, and the current source is configured to generate the mirrored current such that the magnitude of the mirrored current is inversely proportional to the magnitude of the third current.

9. The regulator circuit of claim 7, wherein the first current generator includes a first p-channel metal-oxide semiconductor (PMOS) transistor, a second PMOS transistor and a fifth NMOS transistor, a source of the first PMOS transistor is configured to receive the external power supply voltage, a gate of the first PMOS transistor is connected to a sixth node and a drain of the first PMOS transistor is connected to the fifth node, the drain of the first PMOS transistor is configured to provide the reference current to the fifth node, a source of the second PMOS transistor is configured to receive the external power supply voltage, a gate of the second PMOS transistor is connected to the sixth node and a drain of the second PMOS transistor is connected to the sixth node, a drain of the fifth NMOS transistor is connected to the sixth node, a gate of the fifth NMOS transistor is configured to receive the second reference voltage and a source of the fifth NMOS transistor is connected to the ground voltage supply, and the current source is configured to generate the reference current such that the magnitude of the reference current is proportional to a level of the second reference voltage.

10. The regulator circuit of claim 7, wherein the second current generator includes a first p-channel metal-oxide semiconductor (PMOS) transistor, a fifth NMOS transistor and a sixth NMOS transistor, a source of the first PMOS transistor is configured to receive the external power supply voltage, a gate of the third PMOS transistor is configured to receive the voltage of the first node and a drain of the first PMOS transistor is connected to a sixth node, a drain of the fifth NMOS transistor is connected to the sixth node, a gate of the fifth NMOS transistor is connected to the sixth node and a source of the fifth NMOS transistor is connected to the ground voltage supply, a drain of the sixth NMOS transistor is connected to the fifth node, the drain of the sixth NMOS transistor is configured to draw the mirrored current from the fifth node, a gate of the sixth NMOS transistor is connected to the sixth node and a source of the sixth NMOS transistor is connected to the ground voltage supply, and the current source is configured to generate the mirrored current such that the magnitude of the mirrored current is proportional to a level of the voltage of the third node.

11. The regulator circuit of claim 1, wherein the current mirror includes a first p-channel metal-oxide semiconductor (PMOS) transistor and a second PMOS transistor, a source of the first PMOS transistor is configured to receive the external power supply voltage, a gate of the first PMOS transistor is connected to the third node and a drain of the first PMOS transistor is connected to the first node, the drain of the first PMOS is configured to provide the second current through the first node, a source of the second PMOS transistor is configured to receive the external power supply voltage, a gate of the second PMOS transistor, is connected to the third node and a drain of the second PMOS transistor is connected to the third node, the drain of the second PMOS is configured to provide the first current through the third node, and the current mirror is configured to operate based on an enable signal.

12. A power system comprising:

a regulator circuit configured to generate an internal power supply voltage based on an external power supply voltage; and an operation circuit configured to perform a given operation based on the internal power supply voltage, the regulator circuit including, a power transistor, a source of the power transistor configured to receive an external power supply voltage, a gate of the power transistor connected to a first node, a first voltage being a voltage of the first node, and a drain of the power transistor connected to a second node, the drain of the power transistor configured to output the internal power supply voltage;

a current mirror configured to provide a first current to a third node, a second voltage being a voltage of the third node, the current mirror further configured to provide the first node with a second current having a same magnitude as the first current;

a first n-channel metal-oxide semiconductor (NMOS) transistor, a drain of the first NMOS transistor connected to the first node, a gate of the first NMOS transistor configured to receive a first reference voltage and a source of the first NMOS transistor connected to a fourth node;

a second NMOS transistor, a drain of the second NMOS transistor connected to the third node, a gate of the second NMOS transistor connected to the second node and a source of the second NMOS transistor connected to the fourth node; and a current source configured to draw a third current from the fourth node, the current source configured to, generate a mirrored current having a same magnitude as the first current based on the second voltage, and change a magnitude of the third current based on the mirrored current and a reference current.

13. The power system of claim 12, wherein the current source is configured to increase a voltage adjustment time of the gate of the power transistor to reduce a returning time of a level of the internal power supply voltage to a first level when i) the power transistor changes the level of the internal power supply voltage from the first level to a second level and ii) the regulator circuit changes a magnitude of a load current flowing through the power transistor.

14. The power system of claim 12, wherein the current source is configured to decrease the magnitude of the third current until the magnitude of the mirrored current reaches the magnitude of the reference current, when the magnitude of the mirrored current is greater than a magnitude of the reference current.

15. The power system of claim 12, wherein the current source is configured to increase the magnitude of the third current until the magnitude of the mirrored current reaches the magnitude of the reference current, when the magnitude of the mirrored current is smaller than a magnitude of the reference current.

16. A regulator circuit comprising:

a power transistor, the power transistor configured to generate an internal power supply voltage based on an external power supply voltage, a gate of the power transistor coupled to a first node;

a current mirror configured to output a first current to a second node and a second current to the first node;

at least first and second n-channel metal-oxide semiconductor (NMOS) transistors coupled to the first node and the second node, respectively, each of the first and second NMOS transistors having a source connected to a third node; and a current source connected between the third node and a ground voltage supply, the current source configured to change a magnitude of a third current from the third node based on the first current and the second current.

17. The regulator circuit of claim 16, wherein the current source is configured to, generate a mirrored current having a same magnitude as the first current based on a voltage of the second node, and change the magnitude of the third current based on a difference between the mirrored current and a reference current.

18. The regulator circuit of claim 17, wherein the current source is configured to generate the voltage of the second node.

19. The regulator circuit of claim 16, wherein a gate of one of the first and second NMOS transistors and a drain of the power transistor are connected at a common node.

20. The regulator circuit of claim 16, wherein the current source includes, a current generation circuit configured to generate a fourth current based on the external power supply voltage and a first reference voltage;

a third NMOS transistor, a gate of the third NMOS transistor configured to receive the fourth current, a drain of the third NMOS transistor configured to receive a first portion of the third current and a source of the third NMOS transistor connected to the ground voltage supply; and a fourth NMOS transistor, a gate of the fourth NMOS transistor configured to receive a second reference voltage, a drain of the fourth NMOS transistor configured to receive a second portion of the third current and a source of the fourth NMOS transistor connected to the ground voltage supply.

* * * * *